US006875913B2

(12) United States Patent
Bubar

(10) Patent No.: US 6,875,913 B2
(45) Date of Patent: Apr. 5, 2005

(54) COLLAPSIBLE MUSICAL KEYBOARD

(76) Inventor: David N. Bubar, 273 Delaware Ave., Delmar, NY (US) 12054

( * ) Notice: Subject to any disclaimer, the term of this patent is extended or adjusted under 35 U.S.C. 154(b) by 0 days.

(21) Appl. No.: 10/283,626

(22) Filed: Oct. 30, 2002

(65) Prior Publication Data

US 2004/0083877 A1 May 6, 2004

(51) Int. Cl.[7] ..... G10C 3/12
(52) U.S. Cl. ..... 84/423 R
(58) Field of Search ..... 84/423 R, 424, 84/427, 429, 430, 431, 432

(56) References Cited

U.S. PATENT DOCUMENTS

| | | | | |
|---|---|---|---|---|
| 4,658,695 | A | | 4/1987 | Cutler |
| 4,727,357 | A | | 2/1988 | Curtin et al. |
| 4,729,276 | A | | 3/1988 | Cutler |
| 4,796,007 | A | | 1/1989 | Heys, Jr. |
| D304,162 | S | | 10/1989 | Calkins |
| 4,901,614 | A | | 2/1990 | Kumano et al. |
| 5,067,834 | A | | 11/1991 | Szmanda et al. |
| 5,457,453 | A | | 10/1995 | Chiu et al. |
| 5,463,925 | A | * | 11/1995 | Galocy ..... 84/423 R |
| 5,612,691 | A | | 3/1997 | Murmann et al. |
| 5,625,354 | A | | 4/1997 | Lerman |
| 5,626,428 | A | | 5/1997 | Miwa |
| 5,628,482 | A | | 5/1997 | Iravantchi et al. |
| 5,951,178 | A | | 9/1999 | Lim |
| 6,092,944 | A | | 7/2000 | Butler |
| 6,111,527 | A | | 8/2000 | Susel |
| 6,174,097 | B1 | | 1/2001 | Daniel |
| 6,259,006 | B1 | * | 7/2001 | Parienti ..... 84/171 |

* cited by examiner

*Primary Examiner*—Kimberly R. Lockett
(74) *Attorney, Agent, or Firm*—Schmeiser, Olsen & Watts

(57) ABSTRACT

A musical keyboard that is collapsible between a deployed configuration and a deployed configuration. The musical keyboard including two or more modules, each module containing a different subset of a set of musical keys; and means for collapsing the modules from the deployed configuration in which the modules are arranged in a row to form the musical keyboard, the keyboard being substantially planar, to the collapsed configuration in which the modules are substantially positioned on top of each other.

24 Claims, 7 Drawing Sheets

300
385
415
370
405
400
355
420
380
395
360
390
350
410
375
335
340
320
325
305
310

300
305
320
335
435
430
380
385
375

300
350
345
310
375
305
315
350A
320
330
325
340
380
335

300
380
325
310
375
315
305
340
320
335
355
330
345
385
340

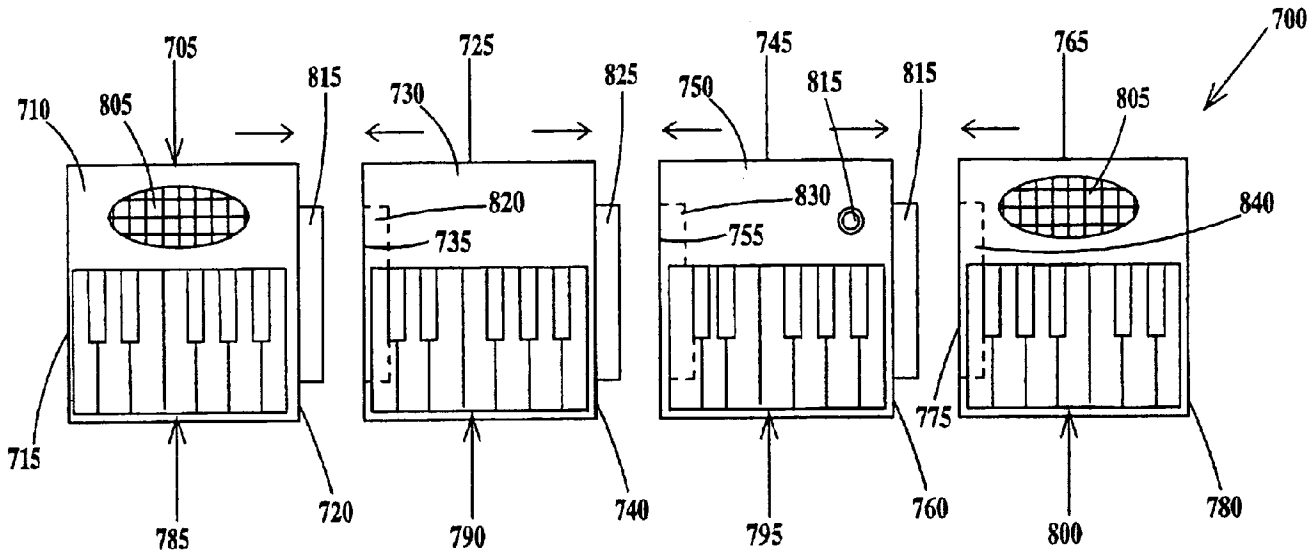
FIG. 4A
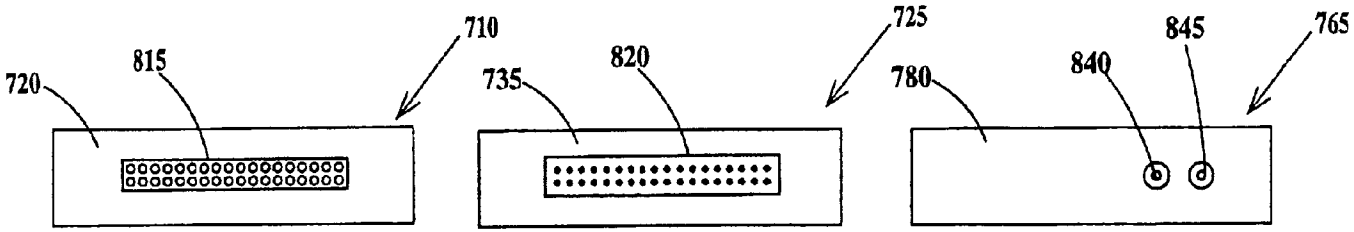
FIG. 4B
FIG. 4C
FIG. 4D

COLLAPSIBLE MUSICAL KEYBOARD

FIELD OF THE INVENTION

The present invention relates to the field of musical keyboards; more specifically, it relates to a compact and portable collapsible musical keyboard and a musical synthesis system utilizing the keyboard.

BACKGROUND OF THE INVENTION

Keyboard music synthesizers are well known and universally available. In one example, a keyboard music synthesizer includes a set of mechanical keys linked to an electronic circuit that synthesizes and then plays a note corresponding to the key depressed. Keyboard music synthesizers are generally less expensive and more compact than the standard instruments they are intended to replace.

There are two forms of keyboard music synthesizers, those having full size keyboards and those having smaller than full size keyboards. As the keyboard size decreases, it becomes increasingly less like the real instrument and in some cases the keys are so small as to allow depression of a single key difficult.

Generally, the full size keyboards are not very portable. Full size keyboards (or even ¾ and ½ scale versions) while often light enough to be transported, are bulky and awkward to carry and maneuver. Keyboards that are small enough to easily carry and maneuver generally have keys too small to play "real" music on. Alternatives, such as personal computer keyboards suffer from the distinct disadvantage of not having the layout of a musical keyboard. When a musical keyboard is displayed on a portable computer screen, the "keys" are very not in a natural position relative the users hands and thus awkward to play.

SUMMARY OF THE INVENTION

A first aspect of the present invention is a musical keyboard comprising: two or more modules, each module containing a different subset of a set of musical keys; and means for collapsing the modules from a deployed configuration wherein the modules are arranged in a row to form the musical keyboard, the keyboard being substantially planar, to a collapsed configuration wherein the modules are substantially positioned on top of each other.

A second aspect of the present invention is a collapsible musical keyboard comprising: one or more adjacent modules arrayed in a row, each pair of adjacent modules being pivotably connected together along a folding axis, the folding axes being mutually parallel; a different subset of a set of musical keys included in each the module; and the musical keyboard being foldable about the folding axes between a deployed configuration in which the musical keyboard is substantially planar and a collapsed configuration wherein the modules are substantially positioned on top of each other.

A third aspect of the present invention is a collapsible musical keyboard comprising: one or more adjacent modules arrayed in a row, each pair of adjacent modules including a plug mounted on a side of the first module of the pair and a recessed socket mounted on a facing side of the second module of the pair, the socket adapted to slidably engage and temporally join each the pair of adjacent modules, the sides of the modules being mutually parallel; and a different subset of a set of musical keys included in each the module.

BRIEF DESCRIPTION OF DRAWINGS

The features of the invention are set forth in the appended claims. The invention itself, however, will be best understood by reference to the following detailed description, of an illustrative embodiment when read in conjunction with the accompanying drawings, wherein:

FIG. 4A is a top exploded view of a collapsible musical keyboard prior to assembly according to a fourth embodiment of the present invention;

FIG. 4B is a side view of a typical plug side of a module of the collapsible keyboard of FIG. 4A;

FIG. 4C is a side view of a typical socket side of a module of the collapsible keyboard of FIG. 4A;

FIG. 4D is a side view of an end module of the collapsible keyboard of FIG. 4A;

DETAILED DESCRIPTION OF THE INVENTION

The term musical keyboard is defined as a keyboard having the functions of and replicating the physical layout of a keyboard typically found on musical instruments such as pianos, accordions, organs or other "keyboard" instruments. However, the term keyboard as used in the present invention is not limited to any one particular set or number of keys. For example, the keyboard, in the context of a piano-like keyboard, may contain the standard numbers of keys (i.e. 88, 61, or 49 keys) or other numbers of keys. While "main deck" (i.e. black and white keys) are illustrated in describing the present invention, other types of keys may be added, such as the "button" keys of an accordion or the stop keys of an organ. The term key is defined as a key normally found on a musical keyboard as previously defined. Individual keys may be standard (full) size or smaller than full size.

Figure 1A:
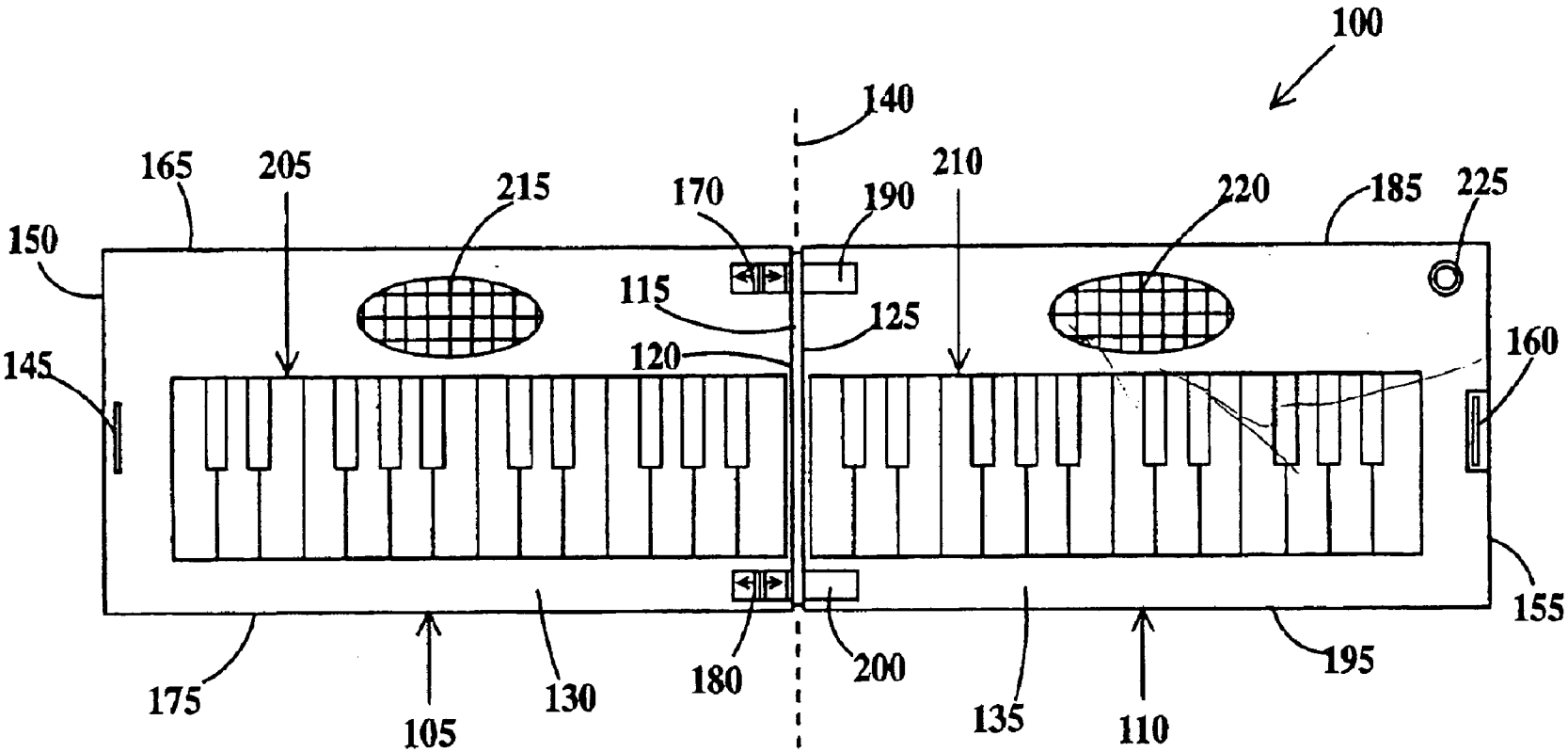
FIG. 1A is a top view of a collapsible musical keyboard in its deployed configuration according to a first embodiment of the present invention.

FIG. 1A is a top view of a collapsible musical keyboard in its deployed configuration according to a first embodiment of the present invention. In FIG. 1A, musical keyboard 100 includes a first module 105 and a second module 110 joined by a hinge 115 between an inner side 120 of first module 105 and an inner side 125 of second module 110. Hinge 115 allows a top surface 130 of first module 105 and a top surface 135 of second module 110 to fold toward each other along folding axis 140 and thus reduce the "footprint" of keyboard 100 by a factor of two.

Located on top surface 130 of first module 105 near an outer side 145 is a protruding latch 150. Located on top surface 135 of second module 110 near an outer side 155 is a recessed catch 160. Latch 150 and catch 160 are located on respective top surfaces 130 and 135 and adapted to engage and thus temporarily fasten the first and second modules together as illustrated in FIG. 1C and described infra.

Located on top surface 130 near the juncture of inner side 120 and a top side 165 of first module 105 is a first slide 170. Located on top surface 130 near the juncture of inner side 120 and a bottom side 175 of first module 105 is a second slide 180. Located in top surface 135 near the juncture of inner side 125 and a top side 185 of second module 110 is a first slot 190. Located in top surface 135 near the juncture of inner side 125 and a bottom surface 195 of second module 105 is a second slot 200. First slide 170 is located on top surface 130 to slidably engage first slot 190 and second slide 180 is located on top surface 130 to slidably engage second slot 200 when first and second modules are fully deployed (the modules are arranged in a row with top surface 130 co-planer with top surface 135) and stop the modules from folding. Alternatively, first slide 170, second slide 180, first slot 190 and second slot 200 may be located respectively on top side 165, bottom side 175, top side 185 and bottom side 195. This alternative arrangement allows one-half key sets 205 and 210 be positioned closer to respective bottom sides 175 and 195. Other locking mechanism may be used in place of slides 170 and 180 and/or slots 190 and 200. For example, pivoting levers may replace the slide 170 and 180 or hinge 115 may be fitted with detents and bumps that engage the detents so that modules 105 and 110 snap into the deployed position and that may be unsnapped with a minimal amount of bending force applied to outer sides 145 and 150.

First module 105 includes a first one-half set of musical keys 205 and second module 110 includes a second one-half set of musical keys 210. Together, first and second one-half sets of musical keys 205 and 210 form a complete set of musical keys. Each one-half key set may comprise spring loaded levers activating momentary switches (instead of hammers as in a piano), rubber dome mechanical keys, metal contact mechanical keys, membrane mechanical keys, foam element mechanical keys, capacitive non-mechanical keys or facsimile key outlines displayed on liquid crystal display (LCD) or light emitting diode (LED) touch sensitive displays.

First module 105 further includes an optional first speaker 215 and second module 110 includes an optional second speaker 220. If speakers 215 and 220 are not used, the overall "foot print" of keyboard 100 in both deployed and collapsed configurations will be reduced. Also, first module 105 may include an on/off switch 225.

Figure 1B:
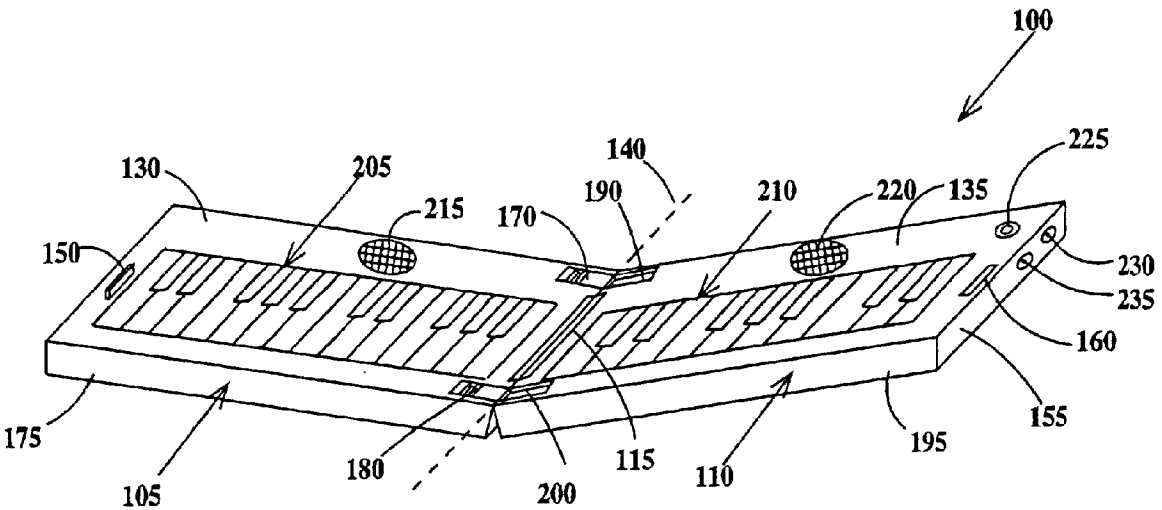
FIG. 1B is an isometric view of the collapsible musical keyboard of FIG. 1A in a partially collapsed configuration.
Figure 1C:
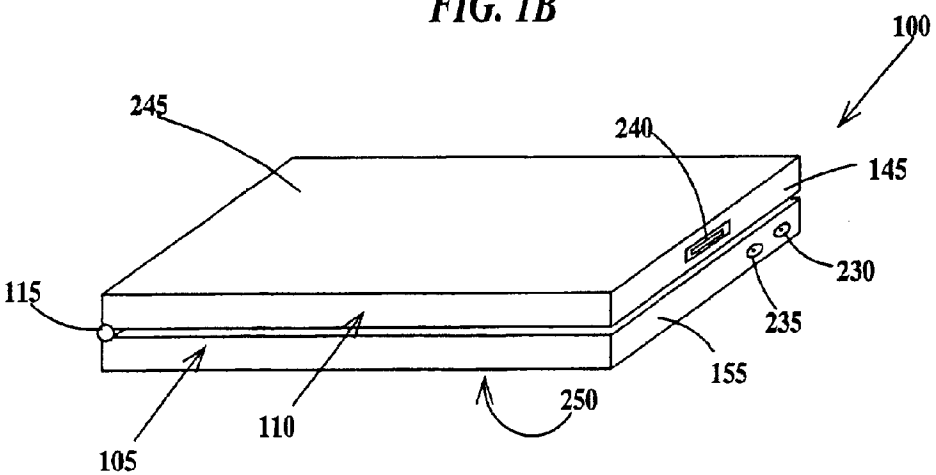
FIG. 1C is an isometric view of the collapsible musical keyboard of FIG. 1A in its fully collapsed configuration.

FIG. 1B is an isometric view of the collapsible musical keyboard of FIG. 1A in a partially collapsed configuration. In FIG. 1B, first and second slides 170 and 180 have been slid back toward first module 105, thereby disengaging the sides from slots 190 and 200 respectively and allowing folding of first and second modules 105 and 110 along folding axis 140.

Figure 5:
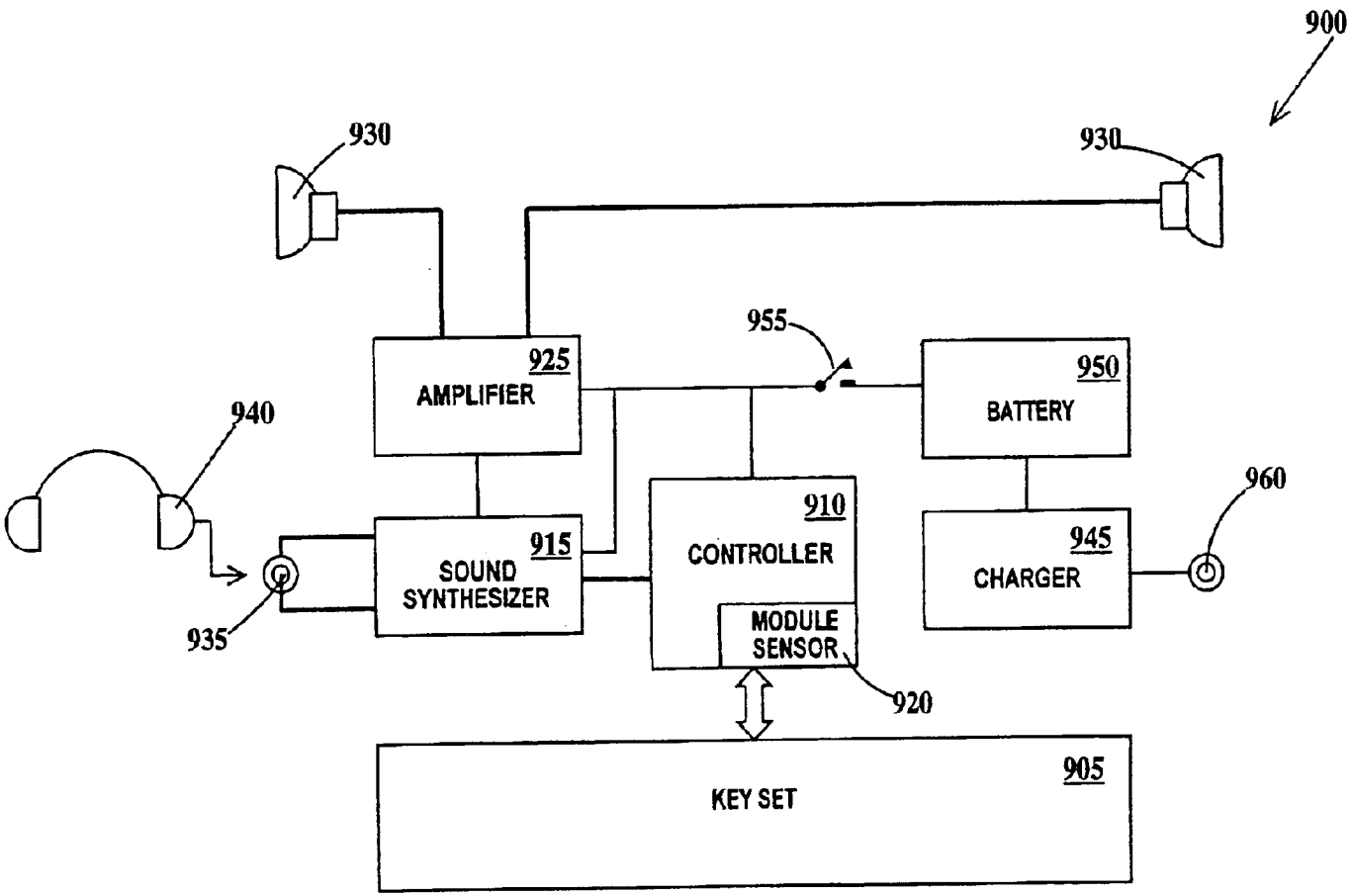
FIG. 5 is a schematic diagram of a system for playing music utilizing the collapsible musical keyboard of the present invention.

Located in outer side 155 of second module 110 are an output jack 230 and an optional power jack 235. Output jack 230 may be used to send key depression signals to an external music simulation device or music to a set of earphones when keyboard 100 includes a complete music simulation system. Speakers 215 and 220, if present, are disabled when earphones or another device are plugged into output jack 230. Power jack 235 allows charging of an internal battery or supplies power from an external source as illustrated in FIG. 5 and described infra.

FIG. 1C is an isometric view of the collapsible musical keyboard of FIG. 1A in its fully collapsed configuration. In FIG. 1C, one last feature is visible. Outer side of 145 of first module 105 includes a release button 240 for disengaging latch 150 from catch 160 (see FIGS. 1A and 1B) in order to open keyboard 100. Note that a bottom surface 245 of first module 105 and a bottom surface 250 of second module 110 serve as an outer protective shell for the fully collapsed keyboard 100 and the modules are stacked or positioned on top of one another.

Finally, it should be understood that each module 105 and 110 includes internal wiring (not shown) required by each module as well as connective wiring (not shown) that connects the two one-half sets of keys 205 and 210 together so they respond as a single keyboard. Further, music simulation electronics, as illustrated in FIG. 5 and described infra, will be contained within one or more of the modules.

Figures 2A, 2B, 2C, 2D:
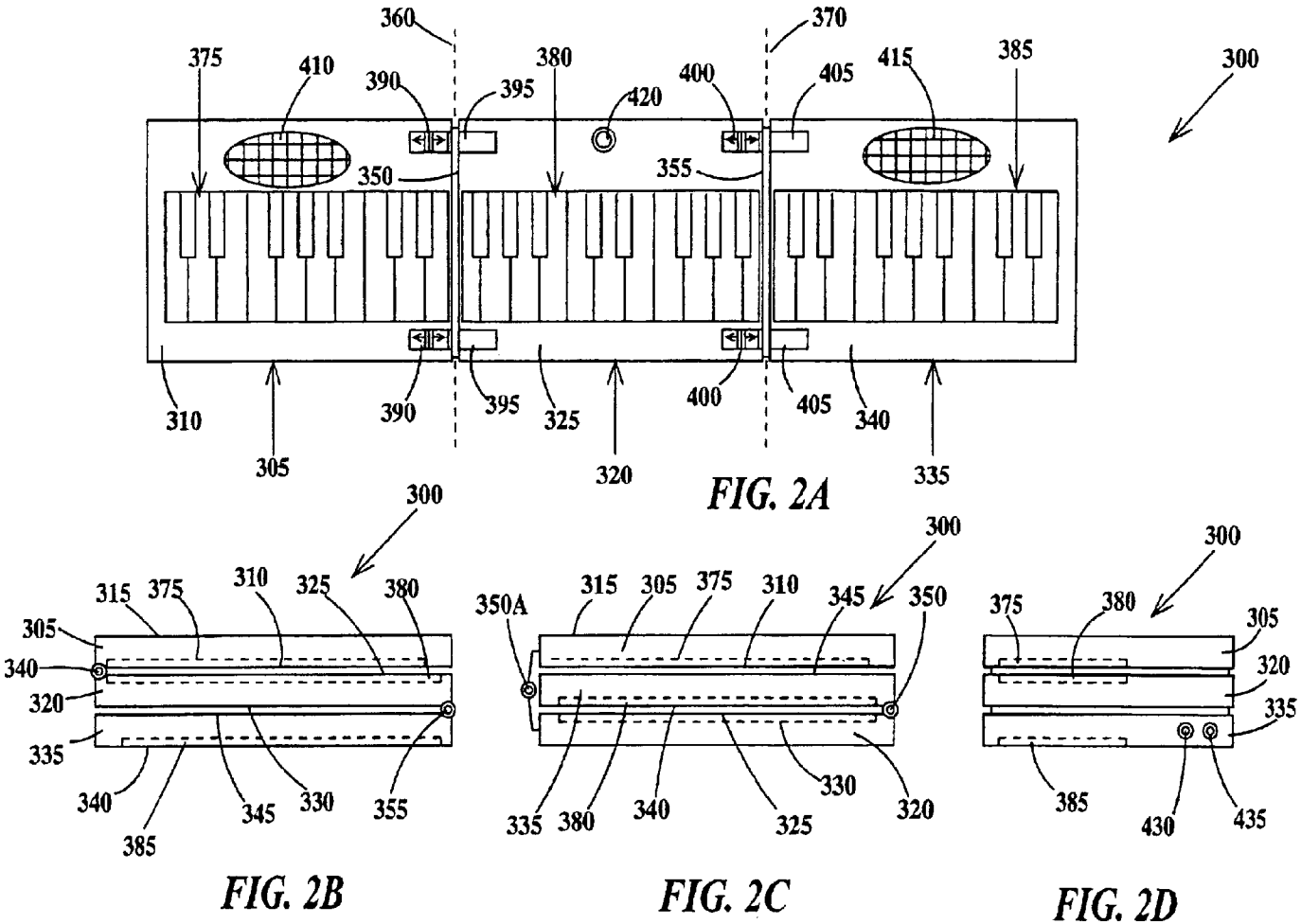
FIG. 2A is a top view of a collapsible musical keyboard in its deployed configuration according to a second embodiment of the present invention.
FIGS. 2B and 2C are front views of the collapsible musical keyboard of FIG. 2A in its collapsed configuration.
FIG. 2D is side view of the collapsible musical keyboard of FIG. 2A in its collapsed configuration.

FIG. 2A is a top view of a collapsible musical keyboard in its deployed configuration according to a second embodiment of the present invention. The principle difference between the second and first embodiments of the present invention is that the second embodiment utilizes three hinged modules instead of two hinged modules. In FIG. 2A, musical keyboard 300 includes a first module 305 having a top surface 310 and an opposite bottom surface 315 (see FIG. 2B), a second module 320 having a top surface 325 and an opposite bottom surface 330 (see FIG. 2B) and a third module 335 having a top surface 340 and an opposite bottom surface 345 (see FIG. 2B). First module 305 is joined to second module 320 by a first hinge 350 and second module 320 is joined to third module 335 by a second hinge 355. First and second hinges 350 and 355 are attached to second module 320 on opposite sides of the module and the first and second hinges are parallel to one another. First hinge 350 is attached to first and second modules 305 and 315 to allow top surface 310 of the first module to pivot along a folding axis 360 toward top surface 325 of the second module. Second hinge 355 is attached to second and third modules 320 and 335 to allow bottom surface 340 (see FIG. 2B) of the third module to pivot along a folding axis 360 toward top surface 330 of the second module. First, and second hinges 350 and 355 are parallel to one another.

First module 305 includes a first one-third set of musical keys 375. Second module 320 includes a second one-third set of musical keys 380. Third module 335 includes a third one-third set of musical keys 385. Together, first, second and third one-third sets of musical keys 375, 380 and 385 form a complete set of musical keys. First, second and third one-third sets of musical keys 375, 380 and 385 are similar to first and second one-half sets of musical keys 205 and 210 described supra.

Located on top surface 310 of first module 305 near first hinge 350 are a pair of slides 390, each slide adapted to slidably engage one of a pair of slots 395 located in top surface 325 of second module 320 near first hinge 350. Located in top surface 325 of second module 320 near second hinge 355 are a pair of slides 400, each slide adapted to slidably engage one of a pair of slots 405 located on top surface 340 of third module 335 near second hinge 355.

Slides 390 and 400 operate similarly to slides 170 and 180 as described supra in reference to FIG. 1A.

First module 305 further includes an optional first speaker 410 and third module 335 includes an optional second speaker 415. If speakers 410 and 415 are not used, the overall "foot print" of keyboard 300 in both deployed and collapsed configurations will be reduced. Also, second module 320 may include an on/off switch 420.

FIGS. 2B and 2C are front views of the collapsible musical keyboard of FIG. 2A in its collapsed configuration. The dashed lines indicate the relative positions of first, second and third one-third musical key sets 375, 380 and 385 in the collapsed configuration of keyboard 300. In the collapsed configuration, keyboard 300 has a "footprint" of one third of the size of the keyboard in the deployed configuration. Alternative hinge 350A may replace hinge 350 (see FIG. 2A) wherein third module 335 may be positioned between first and second modules 305 and 320 so that one-third key set 385 is not exposed in the collapsed position (as illustrated in FIG. 2C) and bottom surfaces 310 and 330 serve as an outer protective shell for the collapsed keyboard 300.

FIG. 2D is side view of the collapsible musical keyboard of FIG. 2A in its collapsed configuration. Located in an outer side 425 of third module 335 are an output jack 425 and an optional power jack 430. Output jack 425 may be used to send key depression signals to an external music simulation device or music to a set of earphones when keyboard 300 includes a complete music simulation system. Speakers 410 and 415, if present, are disabled when earphones or another device are plugged into output jack 425. Power jack 430 allows charging of an internal battery or supplies power from an external source as illustrated in FIG. 5 and described infra. Again, the dashed lines indicate the relative positions of first, second and third one-third musical key sets 375, 380 and 385 in the collapsed configuration of FIG. 2B.

Finally, it should be understood that each module 305, 320 and 335 includes internal wiring (not shown) required by each module as well as connective wiring (not shown) that connects the three one-third sets of keys 375, 380 and 385 together so they respond as a single keyboard. Further, music simulation electronics, as illustrated in FIG. 5 and described infra, will be contained within one or more of the modules.

Figure 3A:
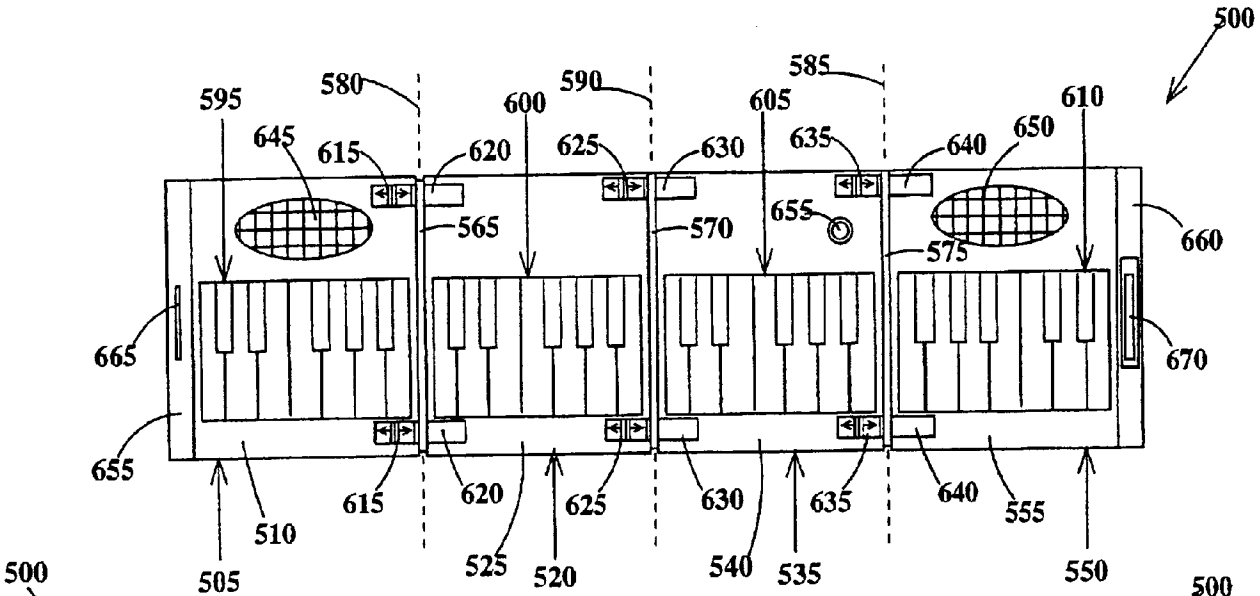
FIG. 3A is a top view of a collapsible musical keyboard in its deployed configuration according to a third embodiment of the present invention.

FIG. 3A is a top view of a collapsible musical keyboard in its deployed configuration according to a third embodiment of the present invention. The principle difference between the third and first and second embodiments of the present invention is that the third embodiment utilizes four hinged modules instead of two or three hinged modules. In FIG. 3A, musical keyboard 500 includes a first module 505 having a top surface 510 and an opposite bottom surface 515 (see FIG. 3B), a second module 520 having a top surface 525 and an opposite bottom surface 530 (see FIG. 3B), a third module 535 having a top surface 540 and an opposite bottom surface 545 (see FIG. 3B) and a fourth module 550 having a top surface 555 and an opposite bottom surface 560 (See FIG. 3B). First module 505 is joined to second module 520 by a first hinge 565, second module 520 is joined to third module 535 by a second hinge 570 and third module 535 is joined to fourth module 550 by third hinge 575. First and second hinges 565 and 570 are attached to second module 525 on opposite sides of the module. Second and third hinges 570 and 575 are attached to third module 535 on opposite sides of the module. First hinge 565 is attached to first and second modules 505 and 520 to allow top surface 510 of the first module to pivot along a folding axis 580 toward top surface 525 of the second module. Third hinge 575 is attached to third and fourth modules 535 and 550 to allow top surface 555 of the fourth module to pivot along a folding axis 585 toward top surface 540 of the third module. Second hinge 570 is attached to second and third modules 520 and 535 to allow bottom surface 530 (see FIG. 3B) of the third module to pivot along a folding axis 590 toward bottom surface 545 (see FIG. 3B) of the third module. First, second and third hinges 565, 570 and 575 are parallel to one another.

First module 505 includes a first one-quarter set of musical keys 595. Second module 520 includes a second one-quarter set of musical keys 600. Third module 535 includes a third one-quarter set of musical keys 605. Fourth module 550 includes a fourth one-quarter set of musical keys 610. Together, first, second, third and fourth one-quarter sets of musical keys 595, 600, 605 and 610 form a complete set of musical keys. First, second, third and fourth one-quarter sets of musical keys 595, 600, 605 and 610 are similar to first and second one-half sets of musical keys 205 and 210 described supra.

Located on top surface 510 of first module 505 near first hinge 565 are a pair of slides 615, each slide adapted to slidably engage one of a pair of slots 620 located in top surface 525 of second module 520 near first hinge 565. Located on top surface 525 of second module 520 near second hinge 570 are a pair of slides 625, each slide adapted to slidably engage one of a pair of slots 630 located in top surface 540 of third module 535 near second hinge 570. Located on top surface 540 of third module 535 near third hinge 575 are a pair of slides 635, each slide adapted to slidably engage one of a pair of slots 640 located in top surface 555 of fourth module 550 near third hinge 575. Slides 615, 620 and 625 operate similarly to slides 170 and 180 as described supra in reference to FIG. 1A.

First module 505 further includes an optional first speaker 645 and fourth module 550 includes an optional second speaker 650. If speakers 645 and 650 are not used, the overall "foot print" of keyboard 500 in both deployed and collapsed configurations will be reduced. Also, third module 535 may include an on/off switch 655.

First module 505 has a raised lip 655 located opposite from the side of the first module that is attached to first hinge 565. Fourth module 550 has a raised lip 655 located opposite from the side of the fourth module that is attached to third hinge 575. Located on raised lip 655 is a protruding latch 665. Located in raised lip 660 is a recessed catch 670. Latch 665 and catch 670 are located and adapted to engage and thus temporarily fasten first and fourth modules 505 and 550 together with second and third modules 520 and 535 in-between the first and third modules as illustrated in FIG. 3B and described infra.

Figure 3C:
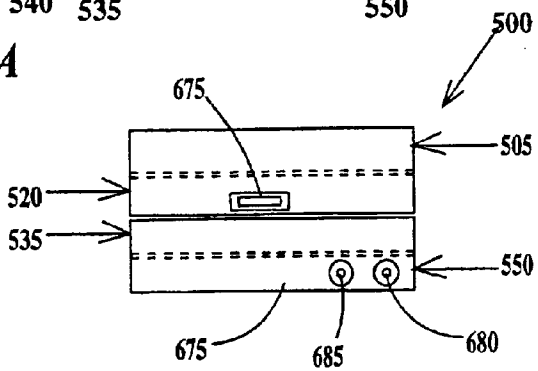
FIG. 3C is side view of the collapsible musical keyboard of FIG. 3A in its collapsed configuration.
Figure 3B:
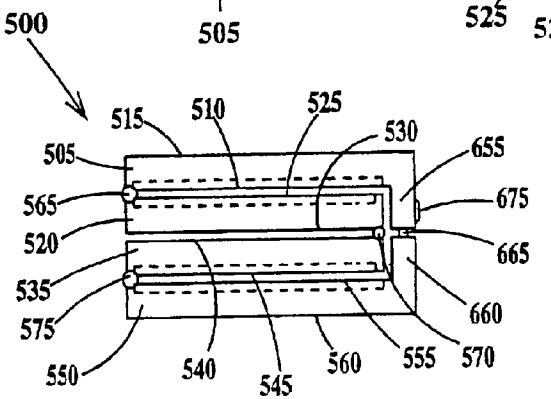
FIG. 3B is front view of the collapsible musical keyboard of FIG. 3A in its collapsed configuration.

FIG. 3B is front view of the collapsible musical keyboard of FIG. 3A in its collapsed configuration. The dashed lines indicate the relative positions of first, second, third and fourth one-quarter musical key sets 595, 600, 605 and 610 in the collapsed configuration of keyboard 500. In the collapsed configuration, keyboard 500 has a "footprint" of one quarter of the size of the keyboard in the deployed configuration. Bottom surface 515 of first module 505 and bottom surface 560 of fourth module 550 serve as an outer protective shell for the collapsed keyboard 500. Raised lip 655 includes a button 675 for disengaging latch 655 from catch 670 (see FIG. 3A).

FIG. 3C is side view of the collapsible musical keyboard of FIG. 3A in its collapsed configuration. Located in an outer side 675 of fourth module 550 are an output jack 680 and an optional power jack 685. Output jack 680 may be used to send key depression signals to an external music simulation device or music to a set of earphones when keyboard 500 includes a complete music simulation system. Speakers 645 and 650, if present, are disabled when earphones or another device are plugged into output jack 680. Power jack 685 allows charging of an internal battery or supplies power from an external source as illustrated in FIG. 5 and described infra. The dashed lines indicate the relative positions of front surfaces 510, 525, 540 and 555 of first, second, third and fourth modules 505, 520, 535 and 550 respectively of keyboard 500 in the collapsed configuration.

Finally, it should be understood that each module 505, 520, 535 and 550 includes internal wiring (not shown) required by each module as well as connective wiring (not shown) that connects the four one-quarter sets of keys 595, 600, 605 and 650 together so they respond as a single keyboard. Further, music simulation electronics, as illustrated in FIG. 5 and described infra, will be contained within one or more of the modules.

FIG. 4A is a top exploded view of a collapsible musical keyboard prior to assembly according to a fourth embodiment of the present invention. In FIG. 4A, musical keyboard 700 includes a first module 705 having a top surface 710 and a first side 715 and an opposite second side 720, a second module 725 having a top surface 730 and a first side 735 and an opposite second side 740, a third module 745 having a top surface 750 and a first side 755 and an opposite second side 760 and a fourth module 765 having a top surface 770 and a first side 775 and an opposite second side 780. While four modules are illustrated as an example, the fourth embodiment of the present invention may utilize more or less than four modules.

First module 705 includes a first one-quarter set of musical keys 785. Second module 725 includes a second one-quarter set of musical keys 790. Third module 745 includes a third one-quarter set of musical keys 795. Fourth module 765 includes a fourth one-quarter set of musical keys 800. Together, first, second, third and fourth one-quarter sets of musical keys 785, 790, 795 and 800 form a complete set of musical keys. First, second, third and fourth one-quarter sets of musical keys 785, 790, 795 and 800 are similar to first and second one-half sets of musical keys 205 and 210 described supra.

First module 705 includes an optional first speaker 805 and fourth module 765 includes an optional second speaker 810. If speakers 805 and 810 are not used, the overall "foot print" of keyboard 700 in both deployed and collapsed configurations will be reduced. Also, third module 745 may include an on/off switch 815.

First module 705 includes a plug 815 on second side 720 adapted to electrically and mechanically engage a socket 820 in first side 735 of second module 725. Second module 725 includes a plug 825 on second side 740 adapted to electrically and mechanically engage a socket 830 in first side 755 of third module 745. Third module 745 includes a plug 835 on second side 760 adapted to electrically and mechanically engage a socket 840 in first side 775 of fourth module 765. Each module 805, 725, 745 and 765 includes internal wiring (not shown) required by each module. Plug/socket combinations 815/820, 825/830 and 835/840 wire the four one-quarter sets of keys 785, 790, 795 and 800 together so they respond as a single keyboard. The four modules 805, 725, 745 and 765 are assembled into the deployed configuration of keyboard 700 (see FIG. 4E) by pushing adjacent pairs of modules in the directions indicated by the arrows. Disassembly into the collapsed configuration of the keyboard (see FIG. 4F) is accomplished by pulling apart adjacent pairs of modules in the direction opposite to that indicated by the arrows.

FIG. 4B is a side view of a typical plug side of a module of the collapsible keyboard of FIG. 4A. In FIG. 4B, module 710 is illustrated and plug 815 is shown on second side 720 of the module.

FIG. 4C is a side view of a typical socket side of a module of the collapsible keyboard of FIG. 4A. In FIG. 4B, module 725 is illustrated and socket 820 is shown on first side 735 of the module.

In FIGS. 4B and 4C, a two row, multi-pin plug and socket combination is illustrated, but other mechanical/electrical connection means may be substituted. For example, a printed circuit board/edge connector combination may be used. Also, the electrical and mechanical connection functions may be separated and separate mechanical connection means used. Music simulation electronics, as illustrated in FIG. 5 and described infra, that are contained within one or more of the modules are connected via the plugs and sockets.

FIG. 4D is a side view of an end module of the collapsible keyboard of FIG. 4A. In FIG. 4D, located in second side 780 of fourth module 765 are an output jack 840 and an optional power jack 845. Output jack 840 may be used to send key depression signals to an external music simulation device or music to a set of earphones when keyboard 700 includes a complete music simulation system. Speakers 805 and 810, if present, are disabled when earphones or another device are plugged into output jack 840. Power jack 845 allows charging of an internal battery or supplies power from an external source as illustrated in FIG. 5 and described infra.

Figure 4E:
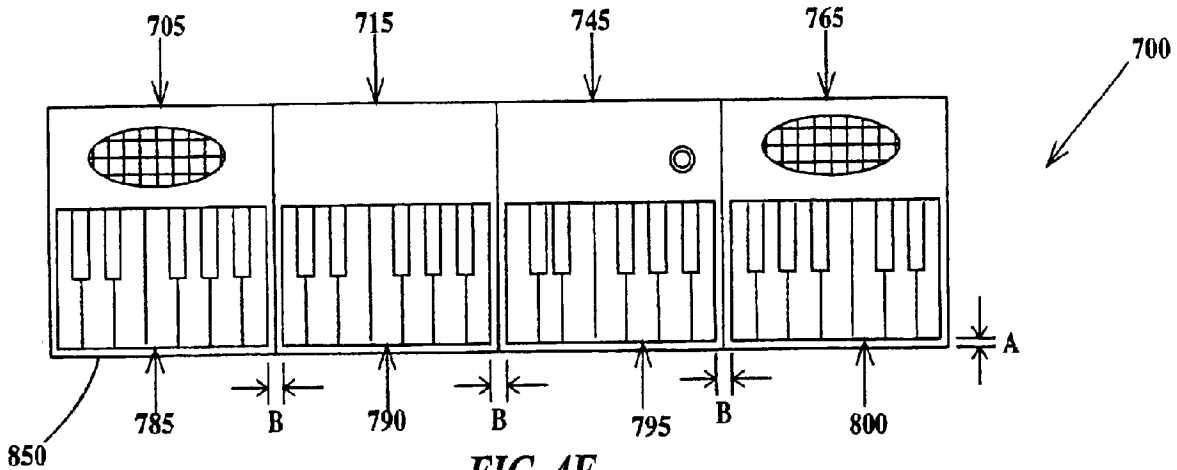
FIG. 4E is a top view of the collapsible musical keyboard of FIG. 4A in its deployed configuration according to the fourth embodiment of the present invention.

FIG. 4E is a top view of the collapsible musical keyboard of FIG. 4A in its deployed configuration according to the fourth embodiment of the present invention.

In FIG. 4E, first, second, third and fourth modules 705, 725, 745 and 755 are assembled into keyboard 700 in its deployed configuration. Several advantages of the fourth embodiment are apparent. First, the distance "A" between the edge of each one-quarter key set 785, 790, 795 and 800 and an edge 850 of the deployed keyboard 700 can be minimized to reduce the "footprint" of the keyboard and second, the distance "B" between adjacent one-quarter key sets can be minimized because there are no hinges.

A third advantage is the musical keyboard of the fourth embodiment of the present invention is scalable. Modules may be added to increase the total number of keys and modules may be removed to reduce the total number of keys in the keyboard. This may be accomplished by adding a module counting function to the electronics supporting the keyboard and is illustrated in FIG. 5 and described infra.

Figure 4F:
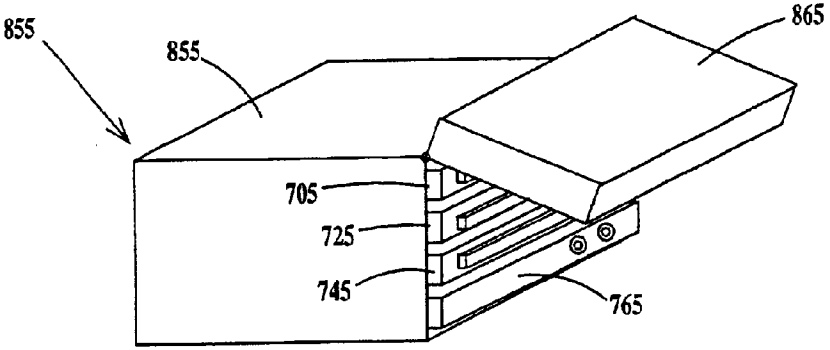
FIG. 4F is an isometric view of the collapsible musical keyboard of FIG. 4A in its carrying case.

FIG. 4F is an isometric view of the collapsible musical keyboard of FIG. 4A in its carrying case. In FIG. 4F, case 855 includes a hollow body 860 and a lid 865. Modules 705, 725, 745 and 765 are illustrated in the stored position in body 860.

FIG. 5 is a schematic diagram of a system for playing music utilizing the collapsible musical keyboard of the present invention. In FIG. 5, music simulation system 900 includes a key set 905 coupled to a controller 910, controller 910 being coupled to a sound synthesizer 915. Key set 905 comprises any set of key sets described in reference to keyboards 100, 300, 500 or 700 described supra. Controller 910 converts individual key depression signals received from key set 905 into a form usable by sound synthesizer 915. Controller 910 may contain a module sensor 920, which determines how may modules and the total number of keys contained in key set 905, modifies the signals sent to sound synthesizer 915 by the controller to correspond to the number of modules and or keys and changes the key to note assignments. Sound synthesizer 915 is coupled to an optional amplifier 925 that drives optional speakers 930. As mentioned supra, speakers 930 need not be present in order to reduce the "footprint" of the keyboard. If no speakers are present, amplifier 925 may be eliminated. Sound synthesizer is also coupled to an output jack 930 that a set of earphones 940 may be plugged into. All components including key set 905, controller 910 and sound synthesizer 915 may conform to or be compatible with the Musical Instrument Digital Interface (MIDI) standard.

Music simulation system 900 may also include a charger 945 (external or internal) for charging a battery 950. Music simulation system 900 may be turned on or turned off by a switch 955. Charger 945 is coupled to a power jack 960 for connection to an external power source. Battery 950 powers controller 910, sound synthesizer 915 and amplifier 925. Key set 900 may be powered through controller 910.

Controller 910 (and module sensor 920 if present), sound synthesizer 915, amplifier 925 and battery 950 are all housed within one or more of modules of the keyboard. Charger 945 may be internal or external to the modules.

The description of the embodiments of the present invention is given above for the understanding of the present invention. It will be understood that the invention is not limited to the particular embodiments described herein, but is capable of various modifications, rearrangements and substitutions as will now become apparent to those skilled in the art without departing from the scope of the invention. Therefore it is intended that the following claims cover all such modifications and changes as fall within the true spirit and scope of the invention.

What is claimed is:

1. A musical keyboard comprising:

two or more modules, each module containing a different subset of a set of musical keys, wherein each said subset of said set of musical keys comprises keys selected from the group consisting of spring loaded levers activating momentary switches, rubber dome mechanical keys, metal contact mechanical keys, membrane mechanical keys, foam element mechanical keys, capacitive non-mechanical keys, facsimile key outlines displayed on a touch sensitive liquid crystal display, and facsimile key outlines displayed on a touch sensitive a light emitting diode display; and means for collapsing said modules from a deployed configuration wherein said modules are arranged in a row to form said musical keyboard, said keyboard being substantially planar, to a collapsed configuration wherein said modules are substantially positioned on top of each other.

2. The musical keyboard of claim 1, wherein said means for collapsing includes mutually parallel hinges connecting adjacent modules in said row of modules.

3. The musical keyboard of claim 1, further including means for maintaining said musical keyboard in the deployed configuration.

4. The musical keyboard of claim 3, wherein said means for maintaining includes, for each pair of adjacent modules, at least one slide slidably mounted on the first module of the pair and at least one corresponding slot on the second module of the pair, said slot adapted to receive a portion of said slide.

5. The musical keyboard of claim 1, wherein said means for collapsing includes, for each said pair of adjacent modules, a plug mounted on a side of the first module of said pair and a recessed socket mounted on a facing side of the second module of said pair, said plug and said socket adapted to slidably engage and temporally join each said pair of adjacent modules.

6. The musical keyboard of claim 5, wherein said plugs and said sockets are adapted to carry electrical signals between said modules.

7. The musical keyboard of claim 1, further including a music synthesizer for generating a signal representing a musical note in response to activation of a key of said musical keyboard.

8. The musical keyboard of claim 7, further including an output jack for presenting said signal to an external device.

9. The musical keyboard of claim 7, further including an amplifier and at least one speaker, said amplifier amplifying said signal and presenting an amplified signal to said at least one speaker.

10. A collapsible musical keyboard comprising:

one or more adjacent modules arrayed in a row, each pair of adjacent modules being pivotably connected together along a folding axis, said folding axes being mutually parallel;

a different subset of a set of musical keys included in each said module, wherein each said subset of said set of musical keys comprises keys selected from the group consisting of spring loaded levers activating momentary switches, rubber dome mechanical keys, metal contact mechanical keys, membrane mechanical keys, foam element mechanical keys, capacitive non-mechanical keys, facsimile key outlines displayed on a touch sensitive liquid crystal display, and facsimile key outlines displayed on a touch sensitive a light emitting diode display; and said musical keyboard being foldable about said folding axes between a deployed configuration in which said musical keyboard is substantially planar and a collapsed configuration wherein said modules are substantially positioned on top of each other.

11. The collapsible musical keyboard of claim 10, further including means for maintaining said musical keyboard in the deployed configuration.

12. The collapsible musical keyboard of claim 10, wherein each said module has a top surface and a bottom surface, said subsets of said set of musical keys presented on said top surface and wherein the bottom surfaces of only two modules are exposed in the collapsed configuration and no top surfaces are exposed.

13. The collapsible musical keyboard of claim 10, further including a music synthesizer for generating a signal representing a musical note in response to activation of a key of said musical keyboard.

14. The collapsible musical keyboard of claim 13, further including an output jack for presenting said signal to an external device.

15. The collapsible musical keyboard of claim 13, further including an amplifier and at least one speaker, said amplifier amplifying said signal and presenting an amplified signal to said at least one speaker.

16. A collapsible musical keyboard comprising:

one or more adjacent modules arrayed in a row, each pair of adjacent modules including a plug mounted on a side of the first module of the pair and a recessed socket mounted on a facing side of the second module of the pair, said socket adapted to slidably engage and temporally join each said pair of adjacent modules, said sides of said modules being mutually parallel; and a different subset of a set of musical keys included in each said module.

17. The collapsible musical keyboard of claim 16, wherein said plugs are engaged in said sockets in a deployed position and said plugs are disengaged from said sockets in a collapsed configuration.

18. The musical keyboard of claim 16, wherein said plugs and said sockets are adapted to carry electrical signals between said modules.

19. The musical keyboard of claim 16, further including a music synthesizer for generating a signal representing a musical note in response to activation of a key of said musical keyboard.

20. The musical keyboard of claim 19, further including an output jack for presenting said signal to an external device.

21. The musical keyboard of claim 19, further including an amplifier and at least one speaker, said amplifier amplifying said signal and presenting an amplified signal to said at least one speaker.

22. The musical keyboard of claim 16, wherein each said subset of said set of keys comprises keys selected from the group consisting of spring loaded levers activating momentary switches, rubber dome mechanical keys, metal contact mechanical keys, membrane mechanical keys, foam element mechanical keys, capacitive non-mechanical keys, facsimile key outlines displayed on a touch sensitive liquid crystal display and facsimile key outlines displayed on a touch sensitive a light emitting diode display.

23. The musical keyboard of claim 16, wherein the number of modules may be changed to increase or decrease the total number of keys in said set of musical keys.

24. The musical keyboard of claim 16, further including:

means for detecting the number of modules linked together;

means for detecting the number of keys in each module; and means for adjusting individual key to note assignments based on the total number of keys.

* * * * *